US006164573A

United States Patent [19]

Li-Ming

[11] Patent Number: 6,164,573

[45] Date of Patent: Dec. 26, 2000

[54] PAPER SHREDDER CAPABLE OF SHARPENING PENCIL

[76] Inventor: Wu Huang Li-Ming, 3F, No. 29, Lane 80, Sec. 1, Dwu Hwu S. Road, Taipei, Taiwan

[21] Appl. No.: 09/417,095

[22] Filed: Oct. 13, 1999

[51] Int. Cl.[7] ..... B02B 7/02

[52] U.S. Cl. ..... 241/100; 241/101.2; 241/236

[58] Field of Search ..... 241/101.2, 36, 241/100, 236

[56] References Cited

U.S. PATENT DOCUMENTS 5,035,366 7/1991 Hashimoto et al. ..... 241/100

*Primary Examiner*—Mark Rosenbaum

*Attorney, Agent, or Firm*—Browdy and Neimark

[57] ABSTRACT

A paper shredder comprises a housing in which a paper cutting apparatus, a driving device, a link mechanism, and a pencil sharpening apparatus are disposed. The housing is provided with a paper feeding port and a through hole. Paper is fed into the paper shredder via the paper feeding port. A pencil is inserted into an aperture of the pencil sharpening apparatus via the through hole of the housing. The pencil sharpening apparatus comprises a gear and a cutter meshing with the gear such that the cutter is actuated by the gear to sharpen the pencil that is inserted into the aperture of the pencil sharpening apparatus.

5 Claims, 6 Drawing Sheets

PAPER SHREDDER CAPABLE OF SHARPENING PENCIL

FIELD OF THE INVENTION

The present invention relates generally to a paper shredder, and more particularly to a paper shredder which is provided with a means for sharpening a pencil.

BACKGROUND OF THE INVENTION

As shown in FIG. 1, a paper shredder 1 of the prior art comprises a housing 3 in which a paper cutting apparatus 4, an electric motor 5, and a link mechanism 6 are housed. The motor 5 and the paper cutting apparatus 4 are connected by the link mechanism 6 such that the paper cutting apparatus 4 is driven by the motor 5 to cut paper into strips. There is a space 8 located in the interior of the housing 3. The space 8 is not used in any manner. The prior art paper shredder 1 has only one function of shredding paper. In light of the paper shredder being ubiquitous in the modern office where a pencil is an indispensable instrument for drawing, marking and writting, a dual-purpose paper shredder is a welcome adjunct to the office.

SUMMARY OF THE INVENTION

The primary objective of the present invention is to provide a dual-purpose paper shredder capable of shredding paper and sharpening pencils.

It is another objective of the present invention to provide a paper shredder whose interior space is fully utilized.

In keeping with the principle of the present invention, the foregoing objectives of the present invention are attained by a paper shredder comprising a housing, a paper cutting apparatus, a driving device, a link mechanism, and a pencil sharpening apparatus. The housing is provided with a paper feeding port. The paper cutting apparatus is housed in the interior of the housing and is provided with two cutters corresponding in location to the paper feeding port of the housing. The paper cutting apparatus is linked with the driving device by the link mechanism. The pencil sharpening apparatus is located side by side with the driving device in the interior of the housing such that an aperture of the pencil sharpening apparatus is corresponding in location to a through hole of the housing.

The foregoing objectives, features, and functions of the present invention will be more readily understood upon a thoughtful deliberation of the following detailed description of two preferred embodiments of the present invention with reference to the accompanying drawings.

DETAILED DESCRIPTION OF THE INVENTION

Figure 1:
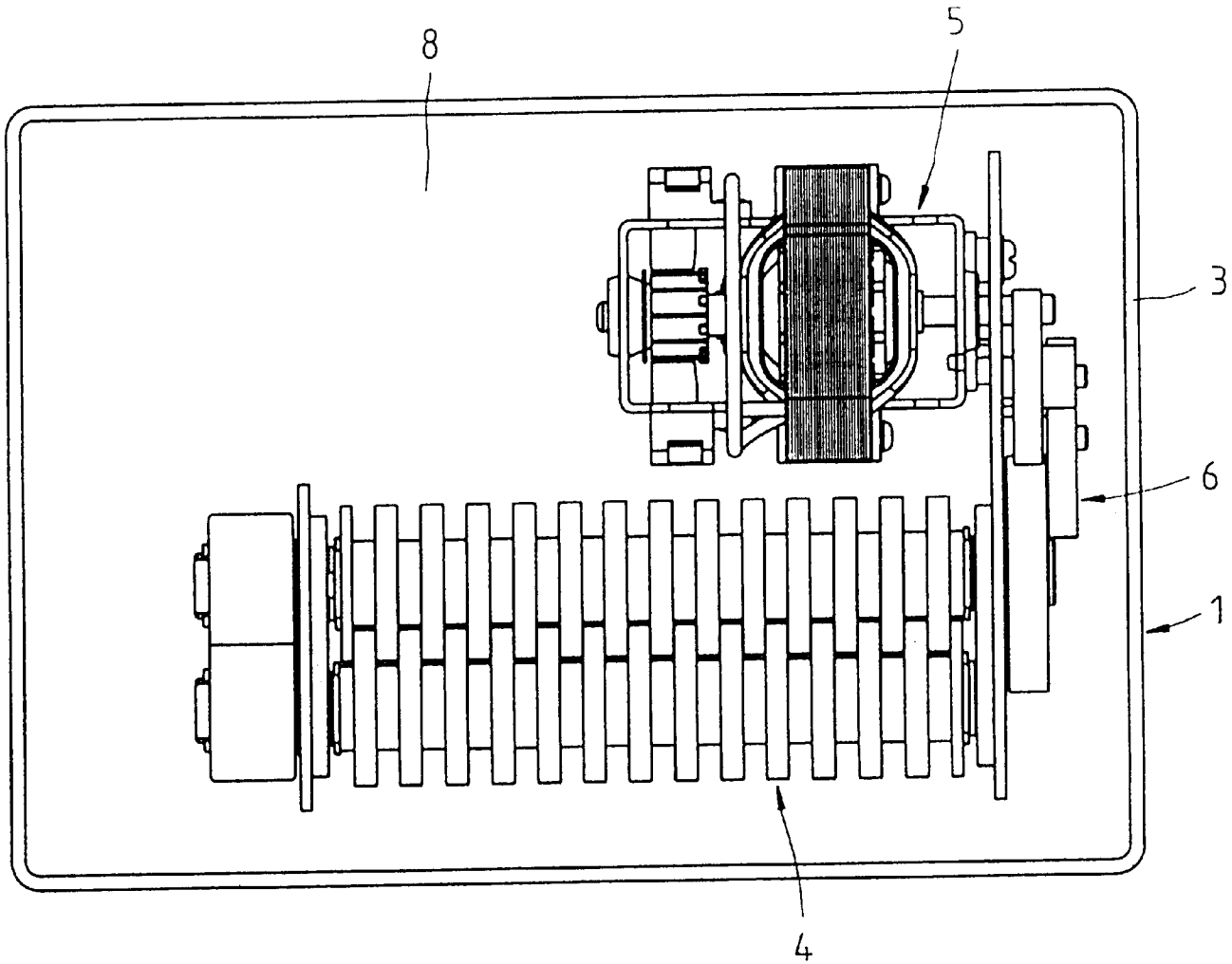
FIG. 1(PRIOR ART)
FIG. 1 shows a schematic view of a layout of the component parts of a paper shredder of the prior art.
Figure 2:
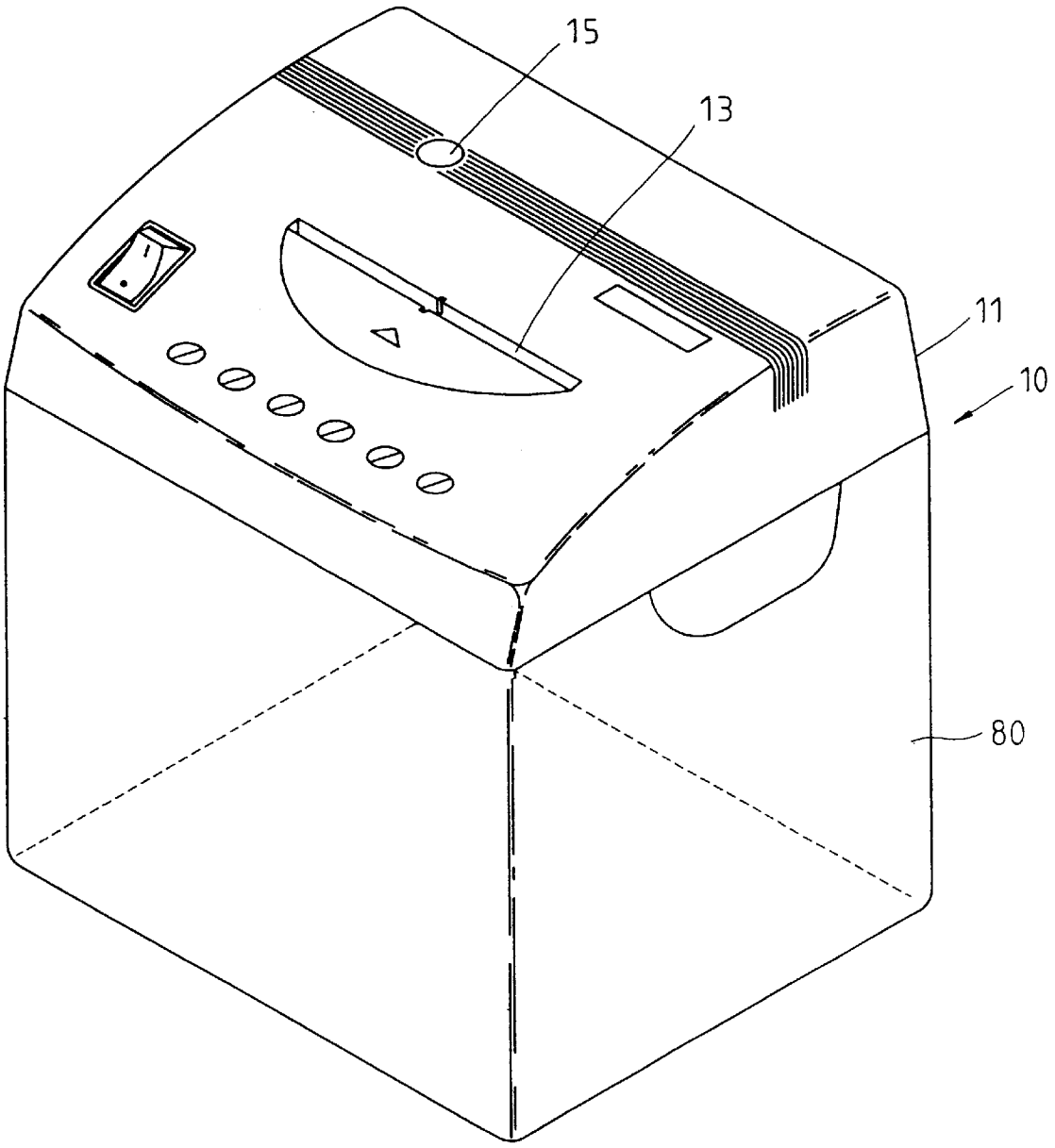
FIG. 2 shows a perspective view of a first preferred embodiment of the present invention.
Figure 3:
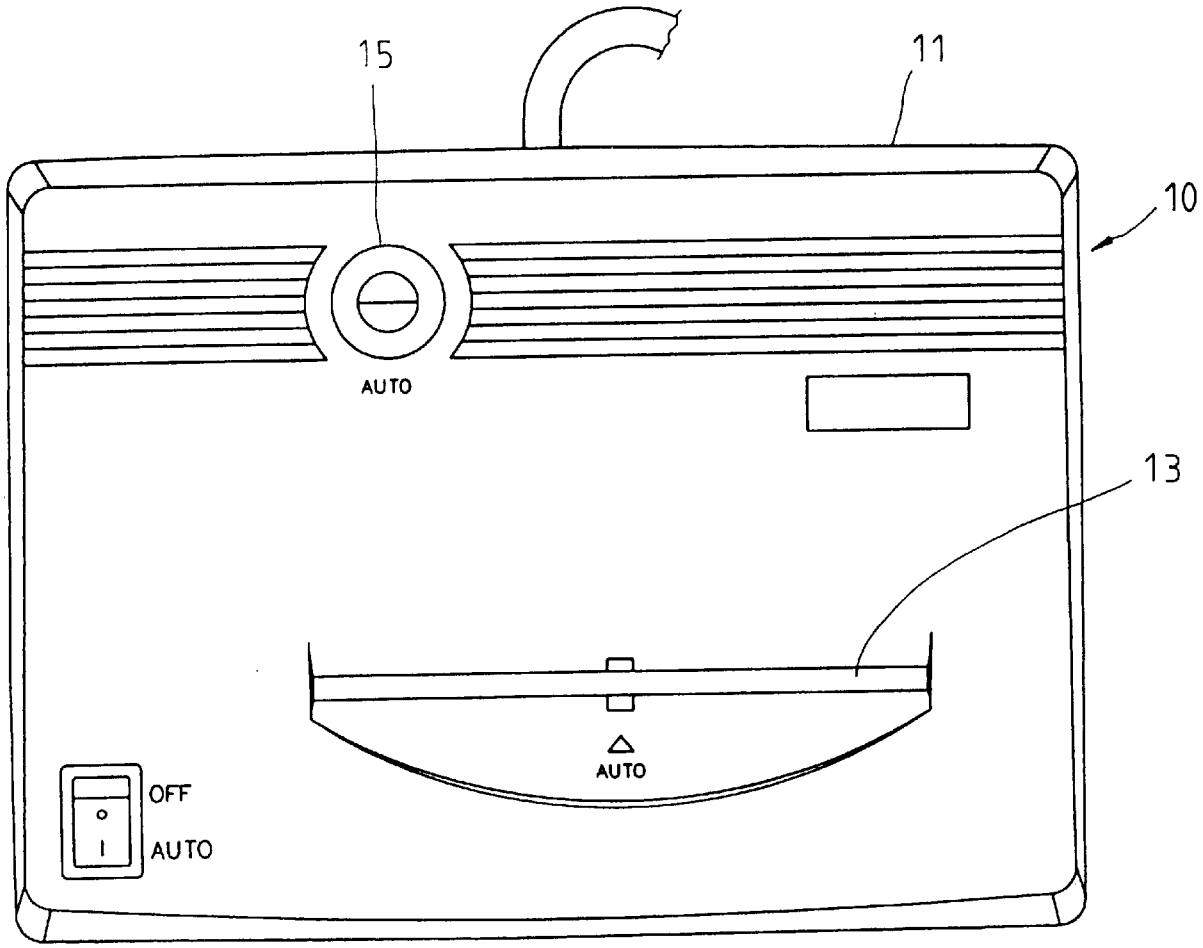
FIG. 3 shows a top view of the first preferred embodiment of the present invention.
Figure 4:
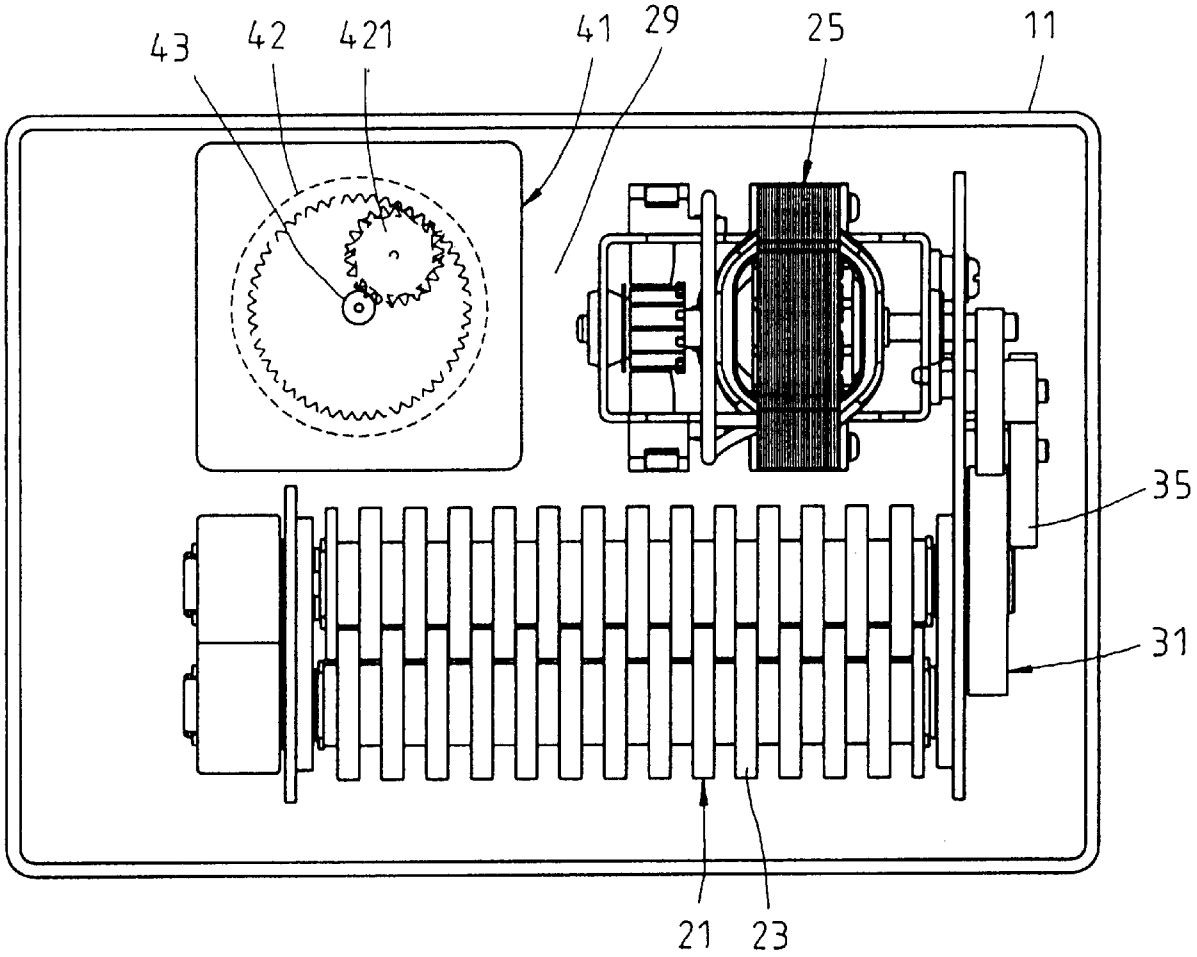
FIG. 4 shows a schematic view of a layout of the component parts of the first preferred embodiment of the present invention.

As shown in FIGS. 2–4, a paper shredder 10 embodied in the present invention is mounted on a paper collecting can 80 and is essentially composed of a housing 11 in which a paper cutting apparatus 21, a driving device 25, a link mechanism 31, and a pencil sharpening apparatus 41 are disposed.

The housing 11 is provided in the top thereof with a paper feeding port 13 and a through hole 15 dimensioned to allow a pencil to be put therethrough.

The paper cutting apparatus 21 comprises two cutters 23 corresponding in location to the paper feeding port 13 of the housing 11.

The driving device 25 is an electric motor and is arranged in the housing 11 such that the driving device 25 is parallel to the paper cutting apparatus 21, and that a space 29 is formed in the proximity of the paper cutting apparatus 21 and the driving device 25.

The link mechanism 31 comprises a plurality of gears (not shown in the drawings) and a plurality of belts 35 linking the driving device 25 and the paper cutting apparatus 21. The motion is imparted by the belts 35 from the driving device 25 to the paper cutting apparatus 21.

The pencil sharpening apparatus 41 is disposed in the space 29 of the interior of the housing 11 and is driven by power of the paper shredder 10. The pencil sharpening apparatus 41 is formed of a gear 42, a cutter 421, and an aperture 43 corresponding in location to the through hole 15 of the housing 11. The gear 42 has teeth which are arranged along the inner wall of the gear 42 such that the teeth of the gear 42 are engaged with those of the cutter 421.

Figure 5:
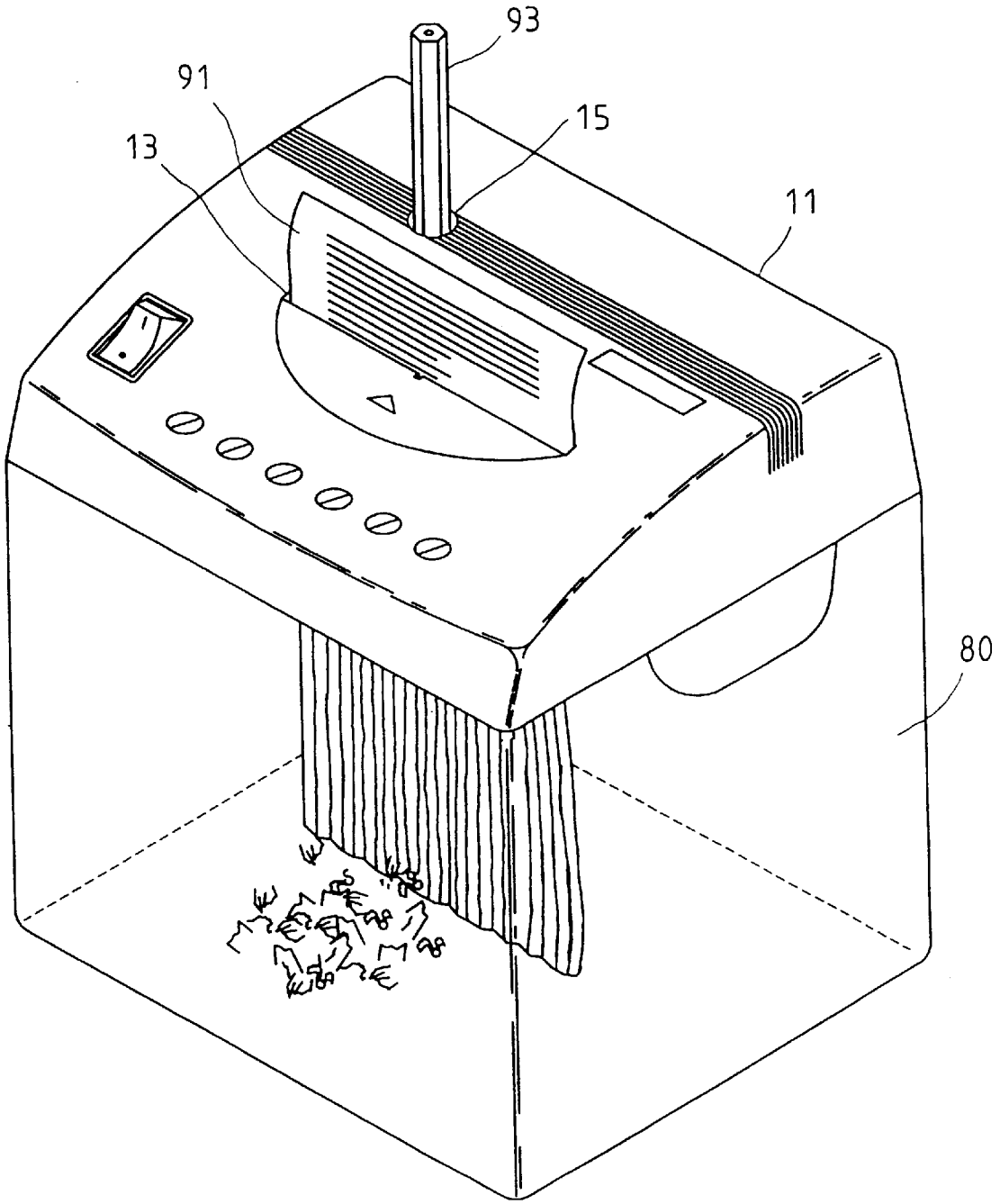
FIG. 5 shows a schematic view of the first preferred embodiment of the present invention in operation.

As shown in FIG. 5, a paper sheet 91 to be shredded is fed into the paper shredder 10 of the present invention via the paper feeding port 13. The paper strips are collected in the paper collecting can 80. A pencil 93 is inserted into the aperture 43 of the pencil sharpening apparatus 41 via the through hole 15 of the housing 11. As the cutter 421 is driven by the gear 42 which is in turn driven by power of the paper shredder 10, the pencil 93, which is received in the aperture 43, is sharpened by the cutter 421 in motion.

Figure 6:
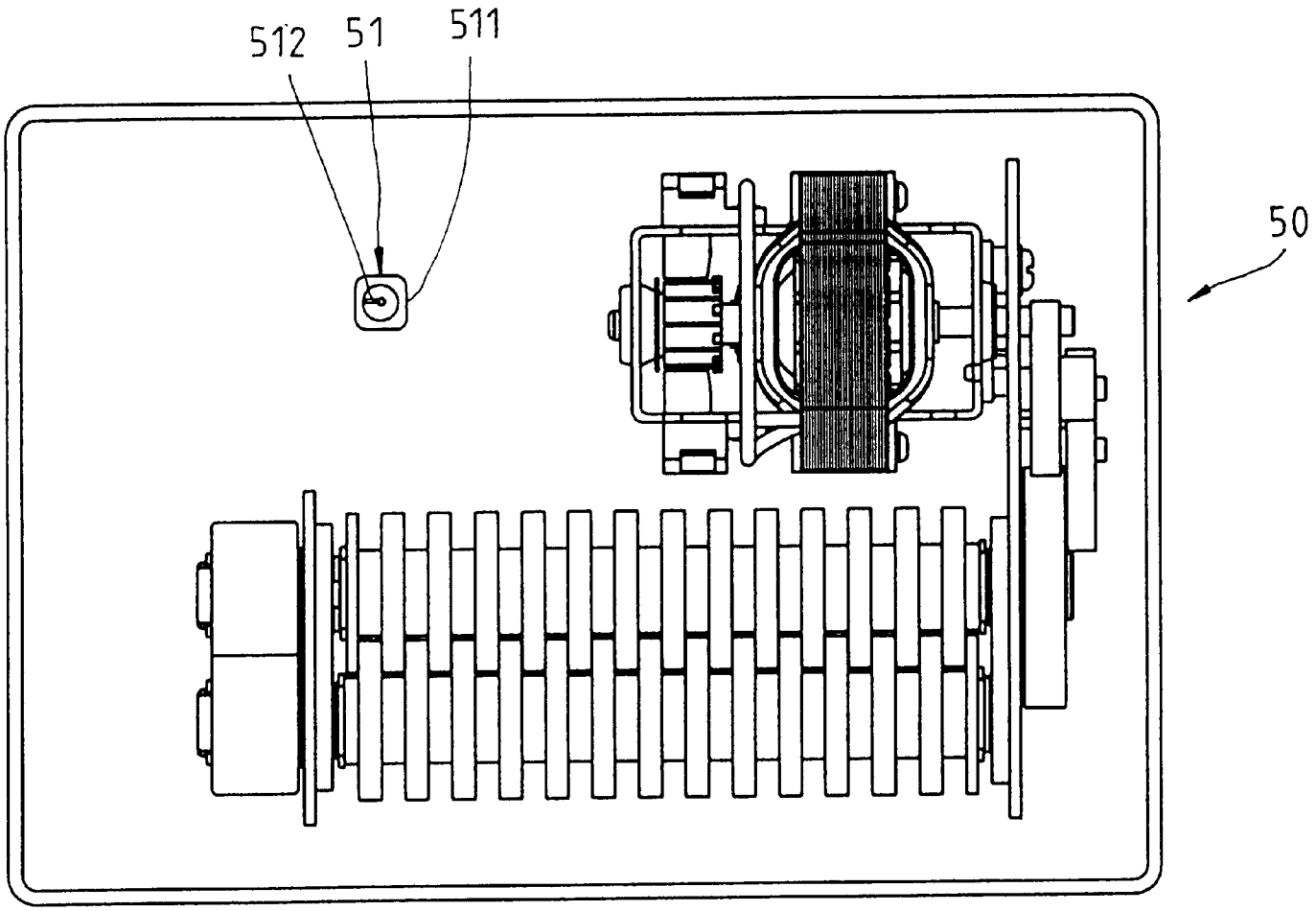
FIG. 6 shows a schematic view of the layout of the component parts of a second preferred embodiment of the present invention.

As shown in FIG. 6, a paper shredder 50 of the second preferred embodiment of the present invention is basically similar in construction to the paper shredder 10 of the first preferred embodiment of the present invention, with the difference being that the paper shredder 50 is provided with a manually-operated pencil sharpener 51, which has a housing 511 and a cutter 512 located in the housing 511. A pencil is sharpened by inserting the pencil into the pencil sharpener 51 such that the pencil is turned with hand.

The paper shredding operation and the pencil sharpening operation of the present invention can be carried out at the same time. Both paper strips and pencil dust are collected in the collection can 80.

What is claimed is:

1. A paper shredder comprising:

a housing provided with a hollow interior and in a top thereof with a paper feeding port and a through hole;

a paper cutting apparatus mounted in said interior of said housing such that said paper cutting apparatus is corresponding in location to said paper feeding port;

a driving device mounted in said interior of said housing;

a link mechanism mounted in said interior of said housing such that said link mechanism is connected with said paper cutting apparatus and said driving device;

wherein said interior of said housing is provided with a pencil sharpening apparatus having an aperture corresponding in location to said through hole of said housing whereby said aperture is intended to insert a pencil into said pencil sharpening apparatus via said through hole of said housing.

2. The paper shredder as defined in claim 1, wherein said driving device is an electric motor; and wherein said pencil sharpening apparatus is electrically operated.

3. The paper shredder as defined in claim 2, wherein said pencil sharpening apparatus is formed of a gear and a cutter, said gear having teeth which are arranged along an inner wall of said gear, said cutter having teeth which are engaged with said teeth of said gear such that said cutter is actuated by said gear to sharpen the pencil that is inserted into said aperture of said pencil sharpening apparatus.

4. The paper shredder as defined in claim 1, wherein said pencil sharpening apparatus is manually operated.

5. The paper shredder as defined in claim 1, wherein said pencil sharpening apparatus has a housing and a cutter disposed in said housing for sharpening a pencil which is turned with hand.

* * * * *

UNITED STATES PATENT AND TRADEMARK OFFICE

CERTIFICATE OF CORRECTION

PATENT NO. : 6,164,573
DATED : December 26, 2000
INVENTOR(S) : Li-Ming Wu Huang

It is certified that error appears in the above-identified patent and that said Letters Patent is hereby corrected as shown below:

Title page,
Item [19], delete "Li-Ming" and insert therefor -- Wu Huang --.
Item [76], Inventor, delete "Wu Huang Li-Ming" and insert therefor -- Li-Ming Wu Huang --.

Signed and Sealed this

Eighteenth Day of June, 2002

*Attest:*

*Attesting Officer*

JAMES E. ROGAN
*Director of the United States Patent and Trademark Office*